US007448843B2

(12) United States Patent
Pilecki, Jr.

(10) Patent No.: US 7,448,843 B2
(45) Date of Patent: Nov. 11, 2008

(54) ROTOR FOR JET TURBINE ENGINE HAVING BOTH INSULATION AND ABRASIVE MATERIAL COATINGS

(75) Inventor: Joseph G. Pilecki, Jr., N. Berwick, ME (US)

(73) Assignee: United Technologies Corporation, Hartford, CT (US)

( * ) Notice: Subject to any disclaimer, the term of this patent is extended or adjusted under 35 U.S.C. 154(b) by 373 days.

(21) Appl. No.: 11/481,111

(22) Filed: Jul. 5, 2006

(65) Prior Publication Data

US 2008/0008581 A1 Jan. 10, 2008

(51) Int. Cl.
*F01D 11/08* (2006.01)

(52) U.S. Cl. ..... 415/1; 415/199.5; 415/174.4; 415/177

(58) Field of Classification Search ..... 415/173.4, 415/174.4, 177; 416/1, 193 A, 189
See application file for complete search history.

(56) References Cited

U.S. PATENT DOCUMENTS

| | | | | |
|---|---|---|---|---|
| 4,738,586 | A * | 4/1988 | Harter | 415/173.5 |
| 5,603,603 | A * | 2/1997 | Benoit et al. | 415/173.4 |
| 6,358,002 | B1 * | 3/2002 | Good et al. | 415/174.4 |
| 6,720,087 | B2 * | 4/2004 | Fried et al. | 428/614 |

* cited by examiner

*Primary Examiner*—Ninh H Nguyen
(74) *Attorney, Agent, or Firm*—Carlson, Gaskey & Olds

(57) ABSTRACT

A gas turbine engine is provided with a seal disk that rotates in a closely spaced relationship to a stationary vane. The stationary vane is provided with an abradable tip. The seal disk is provided with alternating portions of a relatively insulating material and a relatively abrasive material. The insulating material can assist the seal disk in resisting thermal expansion. The abrasive material abrades the abradable tip of the stationary vane, ensuring a close, rotating fit.

20 Claims, 2 Drawing Sheets

ROTOR FOR JET TURBINE ENGINE HAVING BOTH INSULATION AND ABRASIVE MATERIAL COATINGS

BACKGROUND OF THE INVENTION

This application relates to a rotor for use in a gas turbine engine, wherein the rotor rotates closely spaced from a stator blade. A seal disk on the rotor is provided with alternating insulation and abrasive material sections, such that the beneficial properties of each material are enjoyed by the rotor.

A gas turbine engine, such as a turbo fan engine for an aircraft, includes a fan section, a compression section, a combustion section and a turbine section. An axis of the engine is centrally disposed within the engine and extends longitudinally through the sections. A primary flow path for working medium gases extends axially through the sections of the engine.

The fan, compressor and turbine sections each include rotor and stator assemblies. The rotor assemblies include a rotor disk and a plurality of radially extending blades. The blades span across through the flow path and interact with the working medium gases and transfer energy between the fan blades and working medium gases. The stator assemblies include a case and vanes, which circumscribes the rotor assemblies.

One challenge with gas turbine engines is to achieve a good seal between the stator vanes and a seal disk that rotates with the rotors. One way of achieving this seal is the provision of an abradable seal material on the vane. The seal disk rotates in contact with abradable material, such that a seal is provided as the abradable material wears in.

To best achieve this wearing in, it would be desirable to have an abrasive material on the seal disk. On the other hand, the seal disk is subject to very high temperatures. It would be desirable to have an insulation material on the seal disk to assist in resisting thermal expansion.

The goal of providing the features of both the insulation, and the abrasive material, has not been achieved in the prior art. Prior art gas turbine engine designers have had to choose between the two materials.

SUMMARY OF THE INVENTION

In the disclosed embodiment of this invention, a seal disk for a gas turbine engine is provided with alternating areas of a more insulating material, and a more abrasive material. In a disclosed embodiment, grooves are formed into the seal disk, and an insulation material is deposited into the grooves. An abrasive material is coated onto lands between the grooves. In the disclosed embodiment, the grooves are in a spiral arrangement, such that they cover all of an axial width of the seal disk.

These and other features of the present invention can be best understood from the following specification and drawings, the following of which is a brief description.

DETAILED DESCRIPTION OF THE PREFERRED EMBODIMENT

Figure 1:
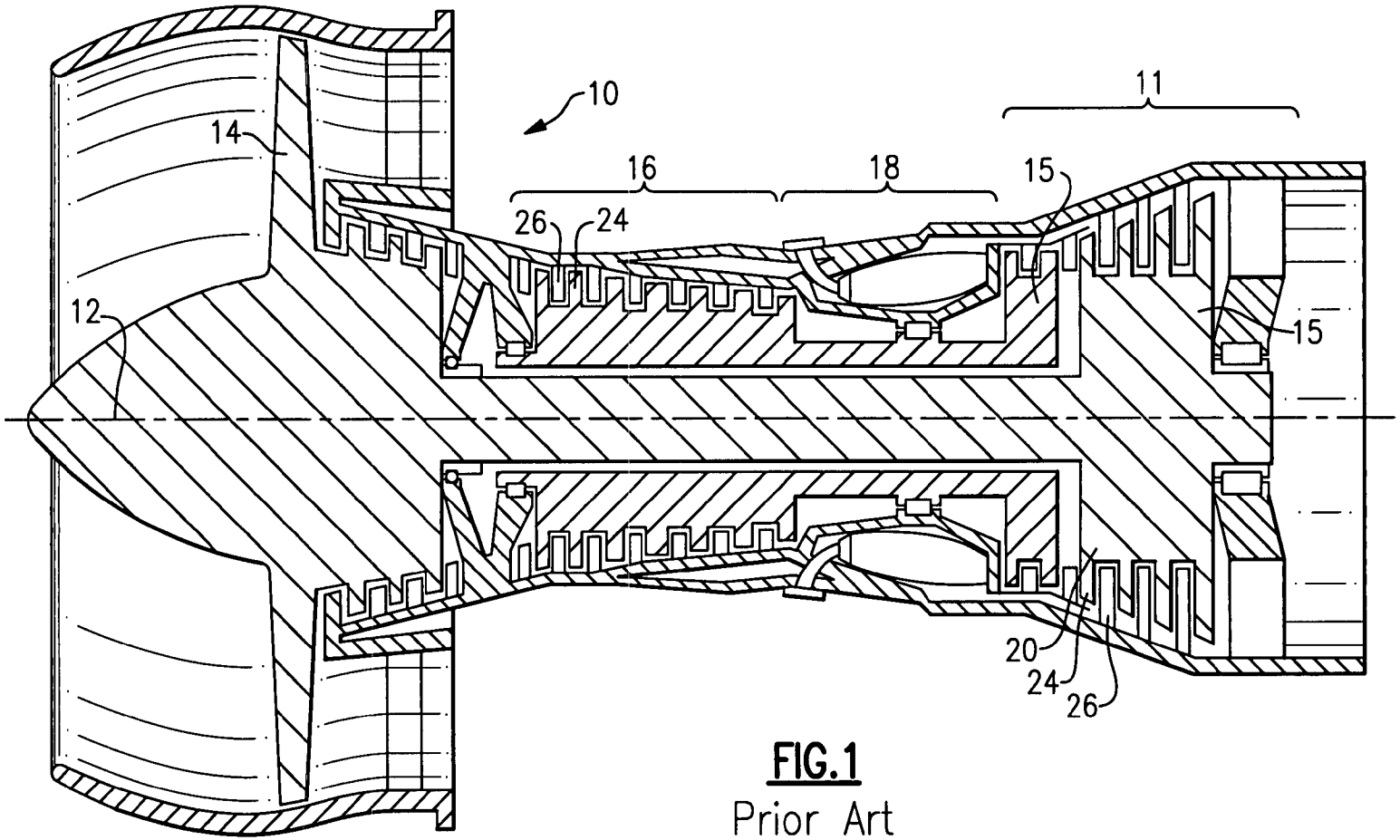
FIG.1 Prior Art
FIG. 1 shows a prior art gas turbine engine somewhat schematically.

A gas turbine engine 10, such as a turbofan gas turbine engine, circumferentially disposed about an engine centerline, or axial centerline axis 12 is shown in FIG. 1. The engine 10 includes a fan 14, a compressor 16, a combustion section 18 and a turbine 20. As is well known in the art, air compressed in the compressor 16 is mixed with fuel which is burned in the combustion section 18 and expanded in turbine 20. The air compressed in the compressor and the fuel mixture expanded in the turbine 20 can both be referred to as a hot gas stream flow. The turbine 20 includes rotors 15 which rotate in response to the expansion, driving the compressor 16 and fan 14. The turbine 20 and compressor 16 both comprise alternating rows of rotary airfoils or blades 24 and static airfoils or vanes 26. This structure is shown somewhat schematically in FIG. 1. In fact, the vanes and rotors are separate parts. While the present invention is discussed in reference to the compressor section, it may also have application in the turbine section.

Figure 2:
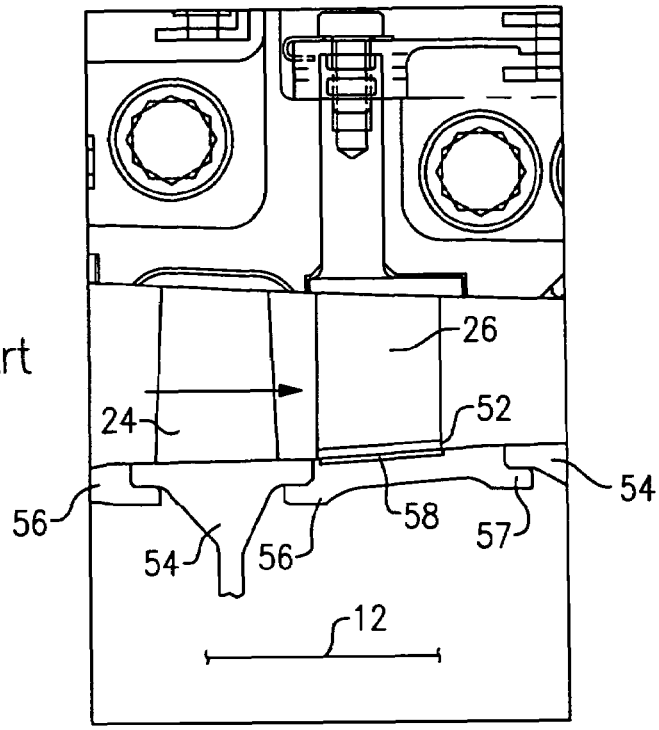
FIG.2 Prior Art
FIG. 2 is a view of a portion of a prior art gas turbine engine.

FIG. 2 shows details of the prior art gas turbine engine. As shown, the turbine blades 24 are spaced from the stationary vanes 26. The stationary vane 26 is provided with an abradable tip seal 52 at its inner periphery. The abradable tip seal 52 is closely spaced from a material 58 on a seal disk 56. The seal disk 56 rotates with a rotor disk 54, and the blade 24.

In the prior art, the material 58 may be selected to be an abrasive material. This assists in cutting into the abradable tip seal 52, and quickly forming a very closely fitting seal. On the other hand, it may be desired to have an insulating material at area 58 to prevent thermal expansion of the seal disk 56. In the prior art, one or the other of these materials were chosen.

Figure 3:
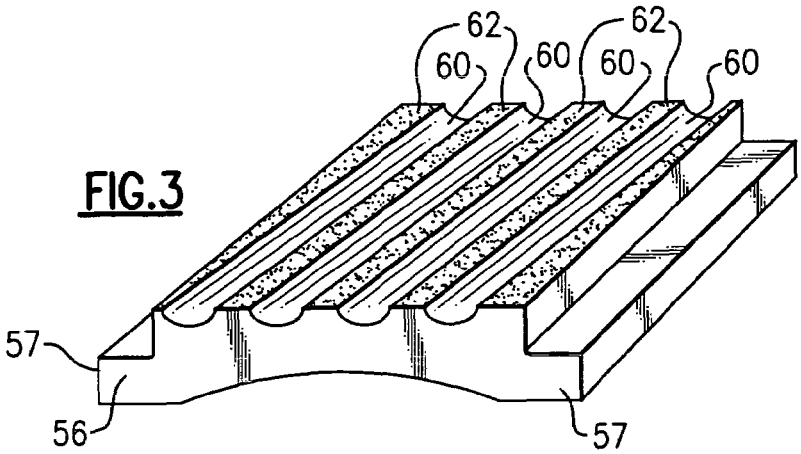
FIG. 3 shows a section of an inventive seal disk.

FIG. 3 shows an inventive seal disk 56. As shown, the seal disk 56 has ears 57 which sit between spaced rotor disks 54. A groove 60 extends circumferentially, and in a spiral fashion about the disk 56. While only a small section is shown in FIG. 3, it should be understood that the groove 60 and seal disk extend across 360°, and the groove for several circuits of 360°. Lands 62 are formed between passes of the groove 60. As discussed, the groove is cut as a thread into the original metal disk. The lands remain after the cutting is complete.

Figure 4:
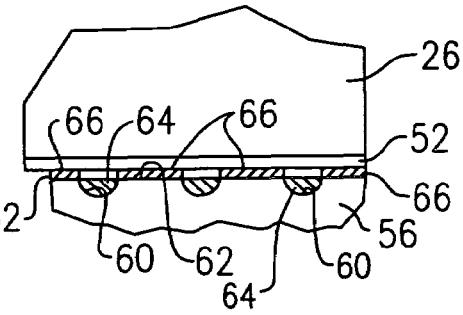
FIG. 4 is a view along a portion of the FIG. 3 seal disk.

As can be appreciated from FIG. 4, an insulating material 64 is deposited into the grooves 60. A more abrasive material 66 is formed on the lands 62. Thus, the abrasive material extends further radially outwardly than the insulating material. As can be appreciated, the abradable tip 52 will contact the more abrasive material 66 as the seal disk 56 rotates relative to the fixed vane 26. In this manner, the abradable material 66 will cut into the abradable tip seal 52, and quickly form a close seal. On the other hand, the insulating material 64 will prevent undue thermal expansion of the seal disk 56.

In a disclosed embodiment, the insulating material may be a ceramic material. The abrasive material may be a cubic boron nitride. While the spiral track is shown in the disclosed embodiment, other groove shapes, pitch sizes, etc. may be optimized to achieve desired thermal and abrasive requirements.

Further, while the seal disk is shown with the combination of the abrasive material and the insulated material, in some applications it may be that the stator vane is provided with these materials, and the abradable portion is formed on the rotating member.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A gas turbine engine comprising:

a fan section, a compressor section, a combustor section, and a turbine section spaced along an axis, and said fan section, said compressor section and said turbine section each being provided with at least one rotor carrying rotating blades; and stationary vanes being positioned adjacent at least one of said fan section, said compressor section and said turbine section, and a rotor seal portion of said rotor in said at least one of said sections, being in sealing contact with a radial inner portion of said stationary vanes, one of said stationary vane and said rotor portion having an abradable material, and the other having a contacting surface with both a relatively insulating material and a relatively abrasive material.

2. The gas turbine engine as set forth in claim 1, wherein said rotor portion is provided with said relatively insulating material and said relatively abrasive material.

3. The gas turbine engine as set forth in claim 2, wherein a seal disk is positioned between adjacent rotors, and said seal disk carrying said relatively insulating material and said relatively abrasive material.

4. The gas turbine engine as set forth in claim 2, wherein said relatively insulating material is positioned in a groove at an outer periphery of said rotor portion.

5. The gas turbine engine as set forth in claim 4, wherein said groove extends in a generally spiral or thread-like manner along said axis.

6. The gas turbine engine as set forth in claim 4, wherein said relatively abrasive material extends radically outwardly from said axis for a greater distance than does said relatively insulating material.

7. The gas turbine engine as set forth in claim 1, wherein said relatively insulating material is a ceramic.

8. The gas turbine engine as set forth in claim 1, wherein said relatively abrasive material is a cubic boron nitride.

9. The gas turbine engine as set forth in claim 1, wherein said at least one section is said compressor section.

10. A rotor for a gas turbine engine comprising:

a rotor carrying rotating blades and having a seal disk; and said seal disk for being in sealing contact with a radial inner portion of a stationary vane, said seal disk having both a relatively insulating material and a relatively abrasive at a radically outer surface.

11. The rotor as set forth in claim 10, wherein said relatively insulating material is positioned in a groove at an outer periphery of said seal disk.

12. The rotor as set forth in claim 11, wherein said groove extends in a generally spiral or thread-like manner along said axis.

13. The rotor as set forth in claim 11, wherein said relatively abrasive material extends radically outwardly from said axis for a greater distance than does said relatively insulating material.

14. The rotor as set forth in claim 10, wherein said relatively insulating material is a ceramic.

15. The rotor as set forth in claim 10, wherein said relatively abrasive material is a cubic boron nitride.

16. A method of operating a gas turbine engine comprising the steps of:

(a) providing at least one rotor section having a rotor and a plurality of blades rotating with said rotor, and positioning stationary vanes to be closely spaced from said rotor;

(b) providing an abradable material on one of said rotor and said stationary vane, and an area on the other of said rotor and said stationary vane having both more abradable material and more insulating material; and (c) rotating said rotor relative to said stationary vanes, and abrading said abradable material with said more abrasive material.

17. The method as set forth in claim 16, wherein said more abrasive material and said more insulating material are provided on a seal disk which rotates with said rotor.

18. The method as set forth in claim 17, wherein a groove is formed at an outer periphery of said seal disk and said more insulating material is deposited in said groove.

19. The method as set forth in claim 18, wherein said groove is formed to extend in a generally spiral or thread-like manner along said seal disk.

20. The method as set forth in claim 18, wherein said generally abrasive material extending radically outwardly from an axis of the gas turbine engine for a greater distance than does said relatively insulating material.

* * * * *

UNITED STATES PATENT AND TRADEMARK OFFICE

CERTIFICATE OF CORRECTION

PATENT NO. : 7,448,843 B2
APPLICATION NO. : 11/481111
DATED : November 11, 2008
INVENTOR(S) : Pilecki, Jr.

It is certified that error appears in the above-identified patent and that said Letters Patent is hereby corrected as shown below:

Claim 20, Column 4, line 41: "radically" should read as --radially--

Signed and Sealed this

Thirteenth Day of January, 2009

JON W. DUDAS
*Director of the United States Patent and Trademark Office*